United States Patent [19]

Dunbar

[11] 4,262,584

[45] Apr. 21, 1981

[54] GRAIN TOWER AERATION STRUCTURE

[76] Inventor: Roger H. Dunbar, 54686 Holly Dr., Elkhart, Ind. 46514

[21] Appl. No.: 64,957

[22] Filed: Aug. 8, 1979

[51] Int. Cl.[3] ..... E04H 7/00

[52] U.S. Cl. ..... 98/55; 34/230; 34/233

[58] Field of Search ..... 34/230, 233, 237; 98/55; 52/198, 303

[56] References Cited

U.S. PATENT DOCUMENTS

| | | | |
|---|---|---|---|
| 2,524,331 | 10/1950 | Rysdon | 98/55 |
| 2,818,009 | 12/1957 | Steffen | 98/55 |
| 3,344,533 | 10/1967 | Peterson | 34/230 |
| 3,572,234 | 3/1971 | Schoenthaler | 98/36 |

FOREIGN PATENT DOCUMENTS

| | | | |
|---|---|---|---|
| 80739 | 3/1952 | Denmark | 34/233 |
| 449076 | 8/1927 | Fed. Rep. of Germany | 34/233 |

*Primary Examiner*—Albert J. Makay
*Assistant Examiner*—Harold Joyce
*Attorney, Agent, or Firm*—Blanchard, Flynn, Thiel, Boutell & Tanis

[57] ABSTRACT

Air chambers underlie the perforated floor of the grain storage chamber of a grain tower. Fans propel air from outside the grain tower into such air chambers. The fans are contained within the tower at bulkheads which divide ones of the air chambers each into a relatively larger air distribution chamber and a relatively smaller air intake chamber. The distribution chamber communicates through the perforations in the perforate floor to aerate grain within the grain compartment. The intake chamber is partly bounded by a portion of the peripheral wall of the tower. The fans draw outside air through limited openings in the tower peripheral wall into such intake chambers.

8 Claims, 3 Drawing Figures

GRAIN TOWER AERATION STRUCTURE

FIELD OF THE INVENTION

This invention relates to structure for aerating grain towers and more particularly to the arrangement of the air moving fans in such a system.

BACKGROUND OF THE INVENTION

Grain towers, or elevators, are widely used for storage of grain and it is necessary to aerate the grain stored therein. To this end, it has been known to provide grain elevators with air blowers and ancillary equipment to flow air from the bottom of the elevator upward through the grain therein and out the top of the elevator. A common prior system provides an air moving device outside the elevator structure with the air being introduced through a pipe extending through the sidewall of the elevator, the pipe branching off into smaller pipes in a "Y", or star, fashion in the grain compartment of the elevator, with perforations in the pipes for leaking the air into the grain compartment. Such prior system has not been entirely satisfactory.

A subsequent prior structure makes use of the fact that most grain elevators are not simply hollow cylinders with a base slab and a roof, but instead normally also include a floor about five or six feet above the base slab, with mechanism such as a grain conveyor being located between the floor and base slab and the grain being stored only above the floor overlying the lower compartment. That prior aeration system provides parallel walls dividing the lower compartment into three chambers, namely a central hallway and two outer chambers flanking same. Moreover, the floor is fabricated as a monolithic mass having numerous slots each covered with plates having substantial numbers of small perforations therethrough, such slots occupying the portion of the floor overlying the two outer chambers. Fans mounted on the outer peripheral surface of the grain elevator each force air under low pressure directly into the aforementioned two outside chambers, such air passing through the perforated floor and rising through the grain thereabove to aerate same.

The latter system, developed by Applicant, has been found to satisfactorily aerate grain in the tower or elevator. However, such system, in common with the earlier prior art system first described above, have a characteristic which in some locations is a substantial disadvantage. Particularly, the fans which supply air to the elevator in these prior structures are located on the exterior of the peripheral wall of the elevator. On an elevator of substantial size there would ordinarily be four of these fans mounted in circumferentially spaced relation on the outer peripheral surface of the elevator near the ground. The fan units are of large size and air flow capacity and tend to be very noisy. In certain locations, complaints from neighbors have caused the elevator owner to mount the fans largely on the side of the elevator away from nearby houses. This positioning will tend to reduce somewhat the noise radiated to houses on the blank side of the elevator, but even to these the noise still may be at an offensive level. Moreover, such concentration of fans on one side of the elevator would, of course, be of no help where nearby neighbors face several sides of the elevator or where adjacent buildings or other structures tend to reflect noise toward neighbors on the blank side of the elevator.

SUMMARY OF THE INVENTION

Accordingly, the objects of this invention include provision of:

A grain tower aeration system which has no aeration fan-motor units outside the grain tower and instead confines the fan-motor units entirely within the grain tower and below the grain supporting floor thereof, so as to reduce the fan-generated noise outside the grain tower.

A system, as aforesaid, which additionally protects the fan-motor units from hostile weather conditions, such as rain, ice build-up, and the like, as well as reducing chances for damage thereto by vandalism.

Other objects and purposes of this invention will be apparent to persons acquainted with apparatus of this general type upon reading the following specification and inspecting the accompanying drawings.

The objects and purposes of the invention are met by providing a grain tower of the kind having a hollow substantially cylindrical tower upstanding from a base slab, wherein a barrier divides the interior of the tower into an upper grain storage compartment and a lower compartment including an air distribution chamber. Perforate openings in the barrier permit air flow from the air distribution chamber upward to aerate grain in the storage compartment. An air intake chamber within the tower communicates through an opening in the outer tower wall with the outside air and also communicates through a further opening in the barrier with the air distribution chamber. An air mover contained within the grain tower passes air from the air intake chamber to the air transfer chamber for subsequent aeration of the grain in the grain compartment.

DETAILED DESCRIPTION

Figure 1:
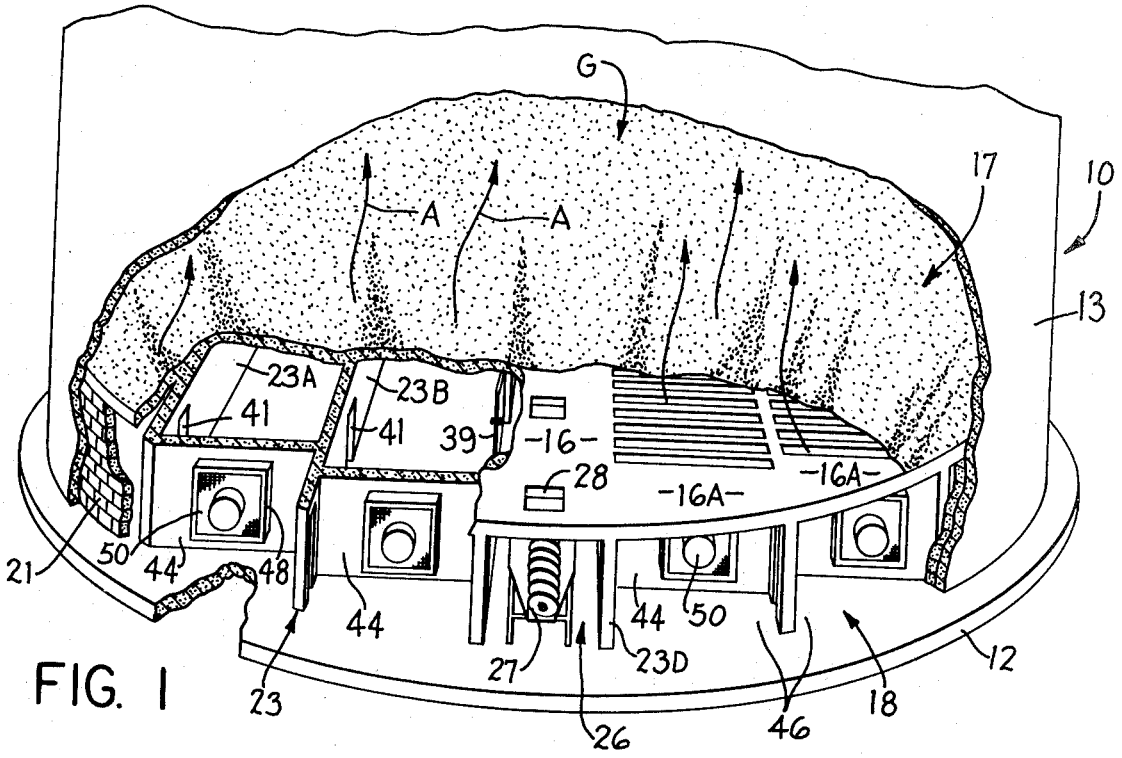
FIG. 1 is a fragmentary, partially broken front view of a grain tower embodying the invention.

FIG. 1 discloses the lower portion of a grain tower 10 embodying the invention. Grain towers are normally tall, circular cross section cylindrical structures. Diameters ranging from 20 feet to 72 feet and heights to 100 feet or more are common. Conventionally, construction is of reinforced concrete, cast in place.

In FIG. 1, tower 10 includes a circular base slab 12 of heavy (for example, 27 inches thick) reinforced concrete supported on the ground. The cylindrical, reinforced concrete peripheral wall 13 of the tower 10 extends upward from base slab 12 and carries a conventional roof structure (not shown) closing the top of the tower. Suitable hatchways or the like (not shown) are conventionally provided in or adjacent such roof for adding grain to the tower.

In the preferred embodiment shown, a grain aeration and support floor 16 extends horizontally across the interior of tower 10, conveniently about 5 or 6 feet above the base slab 12, to divide the tower into an upper grain storage compartment 17 and a lower compartment 18. The floor 16 here shown is a monolithic, reinforced, cast in place concrete structure. The periphery of floor 16 is supported on a step at the inner surface of tower peripheral wall 13, here formed by a circumferential liner wall 21 of concrete-filled concrete block.

The central portion of floor 16 is supported by a plurality of concrete interior walls 23 supported on slab 12. Preferably, the walls 23 extend parallel to each other, along chords of the circular cross section of tower 10, completely across such tower cross section. Ones of such chordal walls are individually indicated at 23A–F. The several walls 23 are spaced as convenient for support of floor 16, for example, on about 8-foot center lines, and will vary in number with the diameter of the tower 10.

The innermost pair of interior walls 23C and 23D are spaced to form a diametrally extending equipment chamber 26 for housing a grain removal conveyor 27 and providing a walkway therebeside. Conventional hatches 28 in floor 16 overlie the conveyor 27 and equipment chamber 26. The hatches 28 are selectively openable and closable from equipment chamber 26 to drop grain from compartment 17 down onto conveyor 27 for removal through an opening 30 in the tower peripheral wall 13 at the end of equipment chamber 26. The conveyor 27 may be arranged to conduct grain out through opening 30 in any manner conventional in grain towers.

Figure 2:
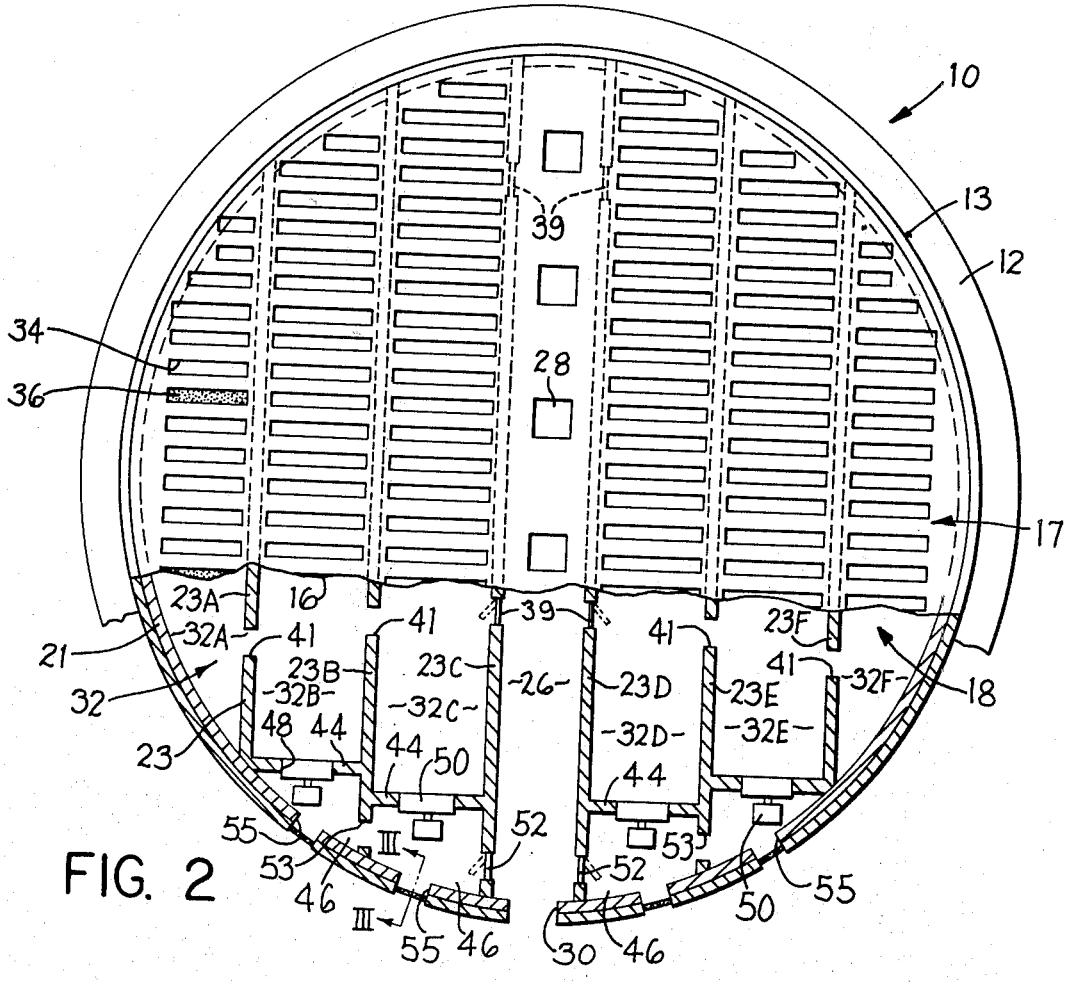
FIG. 2 is a top view of the grain tower of FIG. 1 with the top removed to show the aeration floor and with a portion of the aeration floor broken away to show the air chambers therebelow.

The walls 23 divide the remainder of lower compartment 18 into a plurality, here six, of air chambers 32, individual ones thereof being shown at 32A–F. The tower peripheral wall 13 cooperates with outermost walls 23A and 23F to define the outermost air chambers 32A and 32F, as seen in FIG. 2.

Air openings 34 extend through, and are preferably cast in, floor 16 above each of the air chambers 32 for air flow therefrom upward into grain compartment 17 to aerate grain G in grain compartment 17, as indicated by arrows A in FIG. 1. Air passing through the grain may be exhausted through conventional vents (not shown) at the top of tower 10.

The air openings 34 conveniently take the form of elongate slots extending transverse of the corresponding air chambers 32. To prevent grain G from falling through the slots into the air chambers, the slots 34 are each provided with a multi-perforate plate 36 (one, and for convenience in illustration only one, thereof being shown in FIG. 2) of mesh or hole size small enough to prevent grain from dropping therethrough but large enough to permit air flow upward therethrough. The perforated plates 36 are fixed to floor 16 in any conventional manner.

For maintenance and inspection purposes, human access may be had to lower compartment 18 through an opening, such as conveyor opening 30, in tower peripheral wall 13 into equipment chamber 26. Doorways provided with normally closed doors 39 permit access through walls 23C and 23D from equipment chamber 26 to flanking inner chambers 32C and 32D. The doors 39, when closed, fit tightly within their doorways and may be provided with conventional weather stripping or seals to minimize leakage of air into equipment chamber 26 from the flanking air chambers 23. Further door openings 41 in the remaining ones of the interior walls 23 permit operator access successively into all of the air chambers 32, and substantially equalize air pressure in and air flow through all the air chambers 32 for uniform aeration of grain in compartment 17.

Turning now more specifically to the noise reduction aspect of the present invention, a transverse bulkhead 44 spans the width of at least one (as here shown, two) inner chamber of each of the inner communicating sets of air chambers 32A–C and 32D–F and divides the corresponding air chamber into a relatively small air intake portion 46, leaving the remaining major portion of the air chamber open to the slots 34. Each bulkhead 44 extends full width between the opposed chamber walls 23 and full height between base slab 12 and floor 16 to completely separate the two portions of the air chamber from each other. The part 16A of floor 16 overlying each air intake chamber 46 is free of slots 34 to block flow of air to air intake chambers 46 through floor 16. The small size, in plan, of air inlet chambers 46 adds little to that area of the floor 16 not provided with aeration slots and so does not interfere with effective aeration of the grain G.

Each bulkhead 44 has a central opening 48 therethrough and a motor driven aeration fan 50 (FIGS. 1 and 2) is oriented to force air under relatively low pressure, above atmospheric pressure, through the respective opening 48 from the corresponding air inlet chamber 46 to the corresponding distribution chamber for feeding air upward through the slots 34. As here shown, the fan-motor units 50 are mounted on the bulkheads 44 in inlet chambers 46 and fill the bulkhead openings 48.

As seen in FIG. 2, the inlet chambers 46 are laterally bounded by short portions of the flanking walls 23, the bulkhead 44 and the peripheral wall 13 of the tower. For maintenance and inspection purposes, doorways with normally closed doors 52 in flanking walls 23C and 23D are openable to permit human access from equipment chamber 26 to the flanking ones of air intake chambers 46. Further and normally open doorways 53, as with doorways 41 above mentioned, afford human access and assist air flow and pressure equalization between immediately adjoining air chamber intake portions 46. At least one, and in the preferred embodiment shown all, of the intercommunicating intake chambers 46 have air inlet openings 55 through the peripheral wall 13 (including liner 21) of tower 10 to allow the motor-fan units to draw air from outside the tower.

Figure 3:
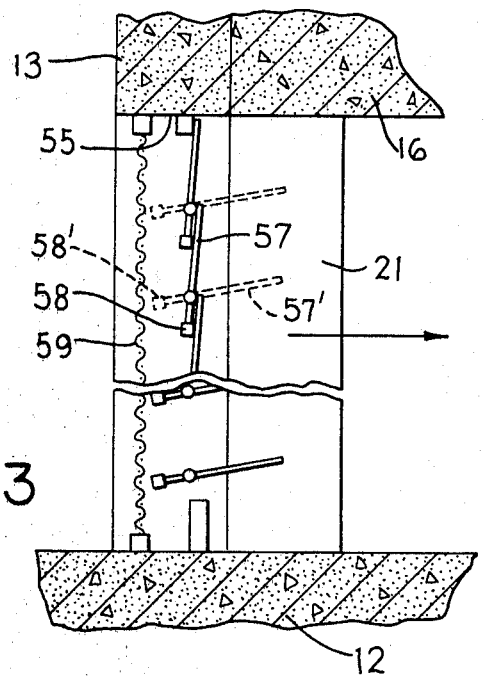
FIG. 3 is an enlarged elevational view substantially taken on the line III—III of FIG. 2.

Openable closures, preferably louvers 57, in the air inlet openings 55, open to allow the fans 50 to draw air into air inlet chamber portions 46, and are closable when the fans are off. The louvers 57, when closed, block unwanted entry of rain or snow and substantially limit entry of unwanted air during very humid weather and may also serve to block entry of larger animals and unauthorized persons into the intake chambers 46. The louvers 57 may be of any convenient kind, for example, to be opened or closed either manually, or electrically as by wiring in parallel with the corresponding fan-motor units 50. By way of example, the particular louvers 57 shown in FIG. 3 are biased to their closed position shown in solid lines, as by counter weights 58, and open to their dotted line positions at 58′ in response to a slight air pressure drop thereacross created by running of the fan 50.

Conventional small mesh screens 59 may also be provided in the air inlets 55 to block entry of insects or small animals into the grain tower 10.

While the component sizes will vary at least to some extent in relation to the size of the grain tower 10, in one embodiment according to the invention, employing a 30-foot diameter tower 10, the air chambers 23B–E were about 8 feet wide, the equipment chamber 26 was about 6 feet wide, the fan openings 48 were square openings about 4 feet wide and the air inlet openings 55 were about 2 feet wide by 6 feet high.

While the operation of Applicants' apparatus will be apparent to skilled persons from the preceding description, same will be briefly summarized below. With at least one of the motor-fan units 50 on each side of equipment chamber 26 operating and its corresponding air inlet opening 55 open, outside air is drawn through the latter into the communicating inlet chamber 46 through the operating fan 50, and is expelled into the adjoining delivery portion of the air chambers 32 under a modest above atmospheric pressure. Pressurized air thus injected by the motor-fan unit or units 50 moves through the several air chambers joined by open doorways 41. The outboard air chambers 32A and 32F are not here provided with their own fans 50 and so receive all aeration flow through the doorways 41. Air thus supplied to the delivery portions of all the air chambers 32 flows under modest pressure up through the perforated plates 36 at the slots 34 in floor 16 and thence upward through the grain G to aerate same and out the aforementioned vents adjacent the roof of tower 10.

The cost of the motor-fan units is minimized by eliminating the need for weather-tight motor-fan construction, due to the fact that they are fully protected from weather by installation well within the air intake enclosures 46. Moreover, by eliminating weather protective housings, the motor-fan units 50 are more quickly and easily serviced and maintained.

Due to the large size of the grain towers and the need to aerate the large quantity of grain storable therein, the fan-motor units 50 must deliver substantial air flow and thus produce correspondingly substantial noise.

Fan noise components which have traditionally been a problem in fan-motor units mounted externally of the tower, are substantially muffled by Applicant's fan-motor mounting arrangement shown. Particularly, noise radiated from the intake side of each fan-motor unit 50, instead of freely radiating in all directions to the outside air, now is largely confined within the corresponding air inlet enclosure 46. Such enclosure 46 is in effect closed to the outside atmosphere except for inlet opening 55, the area of which is very small in comparison to the total noise-receiving surface area of the air inlet enclosure 46. The open louvers 57, and if present screening 59, may to an extent further damp the noise output through air inlet opening 55. Thus, only a very small fraction of the total noise generated by the fan-motor unit 50 can radiate directly therefrom out the inlet opening 55. A portion of the noise energy generated by the fan-motor unit 50 is directly absorbed by the wall surfaces bounding the sides, top and bottom of the enclosure 46. Of the noise energy initially reflected by such walls, a portion will be subsequently absorbed. The great mass of wall structure separating the enclosure 46 from the atmosphere outside the tower 10, limits re-radiation of noise, generated within the chamber 46, by the outside surface of the tower. Particularly, it is obvious that the top and bottom surfaces of enclosure 46 are massive in the extreme view of the overlying load of grain G and underlying earth. Even the exterior sidewall of enclosure 46, comprised for example of an 8-inch poured concrete peripheral wall 3 backed by an 8-inch thick concrete block liner with concrete filled block holes provides a very thick and dense barrier of relatively "dead" material.

Similarly, mechanical vibration applied directly by motor-fan unit 50, to the bulkhead 44 upon which it is mounted, tends to be quickly damped by the massive concrete construction of bulkhead 44 and floor 16, base slab 12, and walls 23 extending therefrom, eliminating any significant transmission of vibration to the outer surface of tower peripheral wall 13.

In this way, the particular arrangement of motor-fan units above disclosed provides adequate aeration without unnecessary noise production.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A grain tower for aerated storage of grain, comprising:

a base slab;

a hollow tower having a substantially cylindrical peripheral wall upstanding from said base slab;

a perforated floor dividing said tower into an upper grain storage compartment and a lower compartment, said perforated floor being spaced above said base slab by a plurality of upstanding walls dividing the space between said base and perforated floor into air chambers;

upstanding bulkheads transversely spanning ones of said air chambers, and dividing same into relatively larger air distribution chambers and relatively smaller air intake chambers with the latter in part bounded by said tower peripheral wall;

means defining air intake openings through said peripheral wall of said tower to each of said air intake chambers;

fans contained within said tower, said fans being located at said bulkheads for impelling air from said air intake chambers through openings in said bulkheads into said air distribution chambers and thence through the perforate part of said perforate floor to aerate grain in said grain storage compartment.

2. The apparatus of claim 1 in which upstanding walls extend substantially parallel to each other across the full width of said tower, said air chambers being elongated along the direction of said walls and extending substantially parallel to each other.

3. The apparatus of claim 2 in which two said air chambers run side-by-side and are separated by a common one of said walls, at least one of said elongate air chambers being equipped with a said bulkhead defining a said small air intake chamber at one end of said air chamber, and including an open doorway in said common wall for substantially equalizing air pressure and flow to and through the two air chambers as provided by the fan in said one air intake chamber.

4. The apparatus of claim 2 in which two said elongate air chambers are arranged side-by-side along a common said wall, each of said elongate air chambers having a said bulkhead adjacent an end thereof to divide a said air intake chamber therefrom, with a said fan at each said bulkhead.

5. The apparatus of claim 4 in which said side-by-side air chambers have their bulkheads and hence air intake chamber portions at the same end thereof such that the two air intake chamber portions are arranged side-by-side, and including an open door through said common wall for providing unimpeded access and equalizing air flow between said side-by-side air intake chambers.

6. The apparatus of claim 2 in which a centrally located pair of said substantially parallel walls are spaced to define a substantially diametrally extending equipment chamber, said equipment chamber being flanked on each side by at least one said air chamber, at least one air chamber on each side of said equipment chamber being provided with a said bulkhead and relatively small air intake chamber, said two walls separating said equipment chamber from the flanking air chambers being provided with tightly closable doors normally preventing significant transfer of air between said equipment chamber and flanking air chambers but openable to permit access from said equipment chamber to each air chamber on both sides of the bulkhead therein.

7. The apparatus of claim 1 in which said air intake opening occupies a minor portion of one wall of said air intake chamber and hence only a small fraction of the total interior surface area of said air chamber, said air intake chamber being entirely bounded by massive concrete barriers constituting said bulkhead, opposed ones of said upstanding walls, the peripheral wall of said tower, said base slab and said floor, said fan being an electric motor-driven fan mounted on said bulkhead within said air intake chamber and spaced from said air intake opening.

8. The apparatus of claim 7 including louvers installed at said inlet opening for opening and closing same, for ultimately permitting the operating fan to draw in air therethrough and to protect the intake chamber and fan from adverse weather conditions with the fan shut off.

* * * * *